US010113210B2

(12) United States Patent
Koriyama et al.

(10) Patent No.: US 10,113,210 B2
(45) Date of Patent: Oct. 30, 2018

(54) HEAT TREATMENT APPARATUS FOR CYLINDER BLOCK AND HEAT TREATMENT METHOD FOR CYLINDER BLOCK

(71) Applicant: TOYOTA JIDOSHA KABUSHIKI KAISHA, Toyota-shi (JP)

(72) Inventors: Shinichi Koriyama, Miyoshi (JP); Yuki Ito, Okazaki (JP); Motoki Sugahara, Hamamatsu (JP); Hiroshi Kitagawa, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 400 days.

(21) Appl. No.: 14/977,108

(22) Filed: Dec. 21, 2015

(65) Prior Publication Data

US 2016/0186279 A1 Jun. 30, 2016

(30) Foreign Application Priority Data

Dec. 26, 2014 (JP) ..... 2014-265477

(51) Int. Cl.

| | |
|---|---|
| ***C21D 9/00*** | (2006.01) |
| ***C21D 1/74*** | (2006.01) |
| *F02F 7/00* | (2006.01) |

(52) U.S. Cl.

CPC ..... *C21D 1/74* (2013.01); *C21D 9/0068* (2013.01); *F02F 7/00* (2013.01)

(58) Field of Classification Search

None

See application file for complete search history.

(56) References Cited

U.S. PATENT DOCUMENTS

| | | | | |
|---|---|---|---|---|
| 4,136,646 | A * | 1/1979 | Lappa | F02B 57/06 123/44 C |
| 2010/0162968 | A1* | 7/2010 | Waldhorn | F02B 23/00 123/2 |
| 2011/0041817 | A1* | 2/2011 | Guerry | F02M 25/0722 123/568.17 |

FOREIGN PATENT DOCUMENTS

| | | | |
|---|---|---|---|
| CN | 103131826 | A | 6/2013 |
| JP | 2004-278930 | | 10/2004 |
| JP | 2008-69432 | A | 3/2008 |
| JP | 2008-303437 | | 12/2008 |
| JP | 2009-191332 | A | 8/2009 |
| JP | 2013-160431 | | 8/2013 |

OTHER PUBLICATIONS

KR 10-2010-053323 (published May 20, 2010), original text and translation from KIPO.*

* cited by examiner

*Primary Examiner* — George Wyszomierski

(74) *Attorney, Agent, or Firm* — Oblon, McClelland, Maier & Neustadt, L.L.P.

(57) ABSTRACT

A heat treatment apparatus for a cylinder block, performs heat treatment by feeding gas. The heat treatment apparatus comprises a first feed part configured to feed the gas toward bores of the cylinder block, from a first side or a second side of the bores in an axis direction of the bores.

4 Claims, 6 Drawing Sheets

HEAT TREATMENT APPARATUS FOR CYLINDER BLOCK AND HEAT TREATMENT METHOD FOR CYLINDER BLOCK

INCORPORATION BY REFERENCE

The disclosure of Japanese Patent Application No. 2014-265477 filed on Dec. 26, 2014 including the specification, drawings and abstract is incorporated herein by reference in its entirety.

BACKGROUND OF THE INVENTION

1. Field of the Invention

The invention relates to technology of a heat treatment apparatus for a cylinder block and a heat treatment method for a cylinder block.

2. Description of Related Art

A cylinder block is publicly known as a component constituting an engine. As a heat treatment apparatus and a heat treatment method for the cylinder block, there are disclosed an apparatus and a method that feed cooling air to both lateral surfaces of the cylinder block, at the time of cooling in the quenching of the cylinder block (Japanese Patent Application Publication No. 2008-303437).

The cylinder block has a complex configuration in which a cylinder and a crankcase are formed by the monoblock casting with an aluminum alloy. Therefore, in a configuration of merely feeding cooling air to both lateral surfaces, as exemplified by the heat treatment apparatus and heat treatment method for the cylinder block disclosed in JP 2008-303437 A, it is likely that the temperature rising or temperature falling of the cylinder block cannot be efficiently performed.

SUMMARY OF THE INVENTION

The invention provides a heat treatment apparatus for a cylinder block and a heat treatment method for a cylinder block that make it possible to efficiently perform the heat treatment.

A heat treatment apparatus according to a first aspect of the invention, performs heat treatment for a cylinder block by feeding gas. The heat treatment apparatus comprises a first feed part configured to feed the gas toward bores of the cylinder block, from a first side or a second side of the bores in an axis direction of the bores.

According to the heat treatment apparatus, which is a first aspect of the invention, it is possible to efficiently perform the heat treatment of the cylinder block.

In the first aspect, the heat treatment apparatus may further comprise a second feed part configured to feed the gas toward a lateral surface of the cylinder block from the first side or the second side, the lateral surface of the cylinder block extending in an array direction of the bores.

In the above aspect, the first feed part may include a first feed hole that is a jet orifice for the gas, the second feed part may include a second feed hole that is a jet orifice for the gas, and at least one of the first feed hole and the second feed hole may be a slit along the array direction the bores of the cylinder block.

In the above aspect, the cylinder block may include a plurality of the cylinder blocks, and the first feed hole and the second feed hole may be longer in the array direction of the bores than a cylinder block that is of the cylinder blocks to be subjected to the heat treatment and that has the longest length in the array direction of the bores.

In the above aspect, the cylinder block may include a plurality of the cylinder blocks, the second feed hole may be arranged, with respect to a predetermined direction perpendicular to the axis direction and the array direction of the bores, outside both lateral surfaces of a cylinder block that is of the cylinder blocks to be subjected to the heat treatment and that has the shortest length in the predetermined direction, and the second feed hole may be arranged, with respect to the predetermined direction, inside both lateral surfaces of a cylinder block that is of the cylinder blocks to be subjected to the heat treatment and that has the longest length in the predetermined direction.

A heat treatment method for a cylinder block, according to a second aspect of the invention, comprises performing heat treatment for the cylinder block by feeding gas toward bores of the cylinder block, from a first side or a second side of the bores in an axis direction of the bores.

According to the heat treatment method, which is a second aspect of the invention, it is possible to efficiently perform the heat treatment of the cylinder block.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
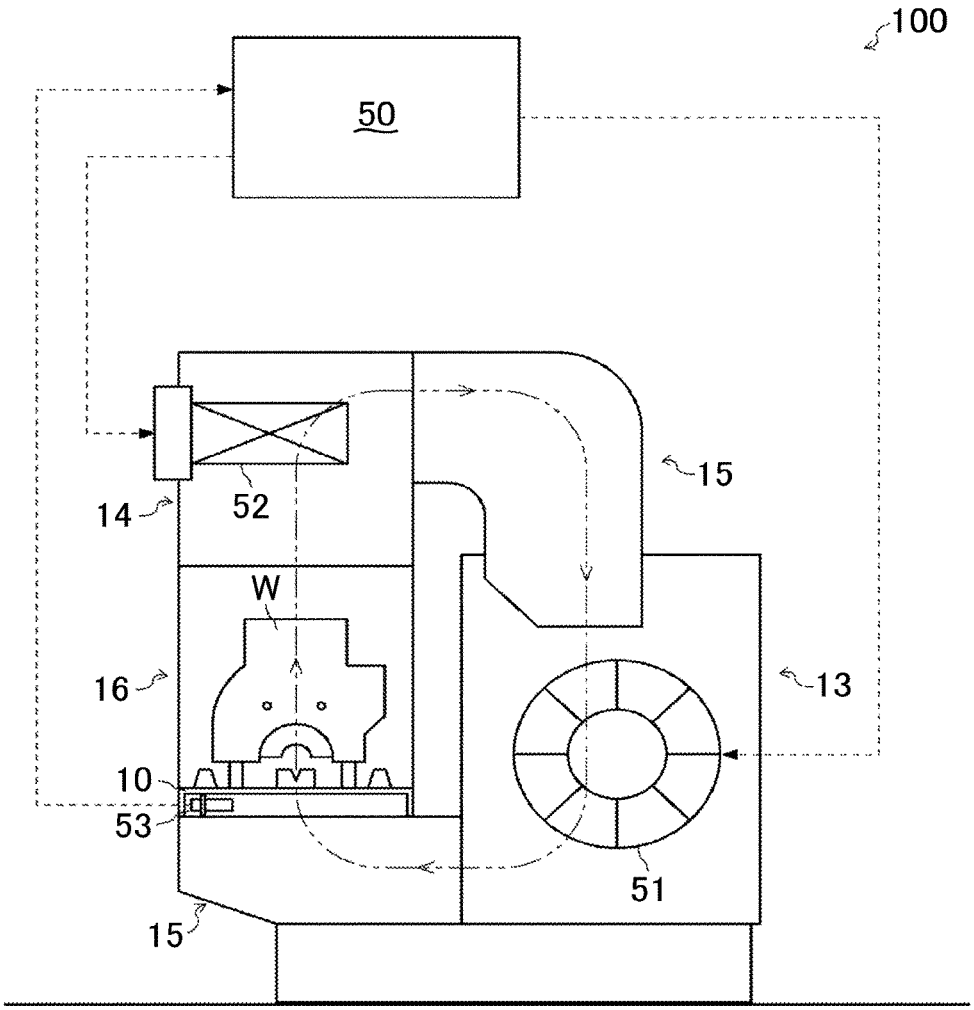
FIG. 1 is a schematic view showing a configuration of a heat treatment apparatus that is an embodiment of the invention.

A configuration of a heat treatment apparatus 100 that is an embodiment of the invention will be described using FIG. 1. FIG. 1 schematically shows the configuration of the heat treatment apparatus 100. The dash lines in FIG. 1 show electric signal lines. The alternate long and two short dashes line in FIG. 1 shows a circulation direction of air. For the simplification of the description, FIG. 1 transparently shows the interior of a treatment chamber 16 and the like.

The heat treatment apparatus 100 is a heat treatment apparatus for embodying a heat treatment method for a cylinder block that is an embodiment of the invention. The heat treatment apparatus 100 in the embodiment is an apparatus that performs heat treatment for a cylinder block W by air that is gas. Further, the heat treatment apparatus 100 in the embodiment is configured to raise the temperature of the cylinder block W for aging treatment.

The heat treatment apparatus 100 includes a feed unit 10, a circulation fan containing chamber 13, a heater containing chamber 14, a plurality of circulation ducts 15, the treatment chamber 16, a control apparatus (hereinafter, referred to as a controller) 50, a circulation fan 51, and a heater 52. In FIG. 1, the circulation ducts 15 include an upper duct and a lower duct.

In the heat treatment apparatus 100, the treatment chamber 16 and the heater containing chamber 14 are communicated with each other, the heater containing chamber 14 and the circulation fan containing chamber 13 are communicated with each other through the circulation duct 15, and the circulation fan containing chamber 13 and the treatment chamber 16 are communicated with each other through the circulation duct 15. Thereby, a circulation path for air is configured.

The circulation fan containing chamber 13 contains the circulation fan 51. The circulation fan 51 is connected with the controller 50, and by the circulation fan 51, the air is circulated in the circulation path.

The treatment chamber 16 is communicated with the downstream side of the circulation fan containing chamber 13 through the circulation duct 15. In the circulation path, the air is circulated by the circulation fan 51, in the order: the circulation fan containing chamber 13→the circulation duct 15→the treatment chamber 16→the heater containing chamber 14→the circulation duct 15→the circulation fan containing chamber 13.

The treatment chamber 16 contains the cylinder block W, which is an object of the heat treatment. The feed unit 10 is arranged at a lower end part of the treatment chamber 16, that is, at an end part (upstream-side end part) of the treatment chamber 16 that is on the upstream side in the flow direction of the air. On the upstream side of the feed unit 10, a temperature sensor 53 is provided. The temperature sensor 53 is connected with the controller 50.

The heater containing chamber 14 is communicated with an end part (downstream-side end part) of the treatment chamber 16 that is on the downstream side in the flow direction of the air. The heater containing chamber 14 contains the heater 52.

The controller 50 is configured to control the circulation fan 51 and the heater 52 such that the air is sent into the treatment chamber 16 at a predetermined temperature and at a predetermined air flow. The controller 50 is connected with the circulation fan 51, the heater 52 and the temperature sensor 53.

The controller 50 has a function to detect the temperature of the air to be sent into the treatment chamber 16 by the temperature sensor 53. Further, the controller 50 has a function to control the circulation fan 51 and the heater 52 such that the air is sent into the treatment chamber 16 at the predetermined temperature and at the predetermined air flow.

The heat treatment apparatus 100 in the embodiment is configured to control the circulation fan 51 and the heater 52 such that the air is sent into the treatment chamber 16 through the feed unit 10, for example, at a temperature of 200° C. and at an air flow of 20 m/s. The invention is not limited to the embodiment, and for example, the temperature and air flow of the air may be appropriately altered.

Figure 2:
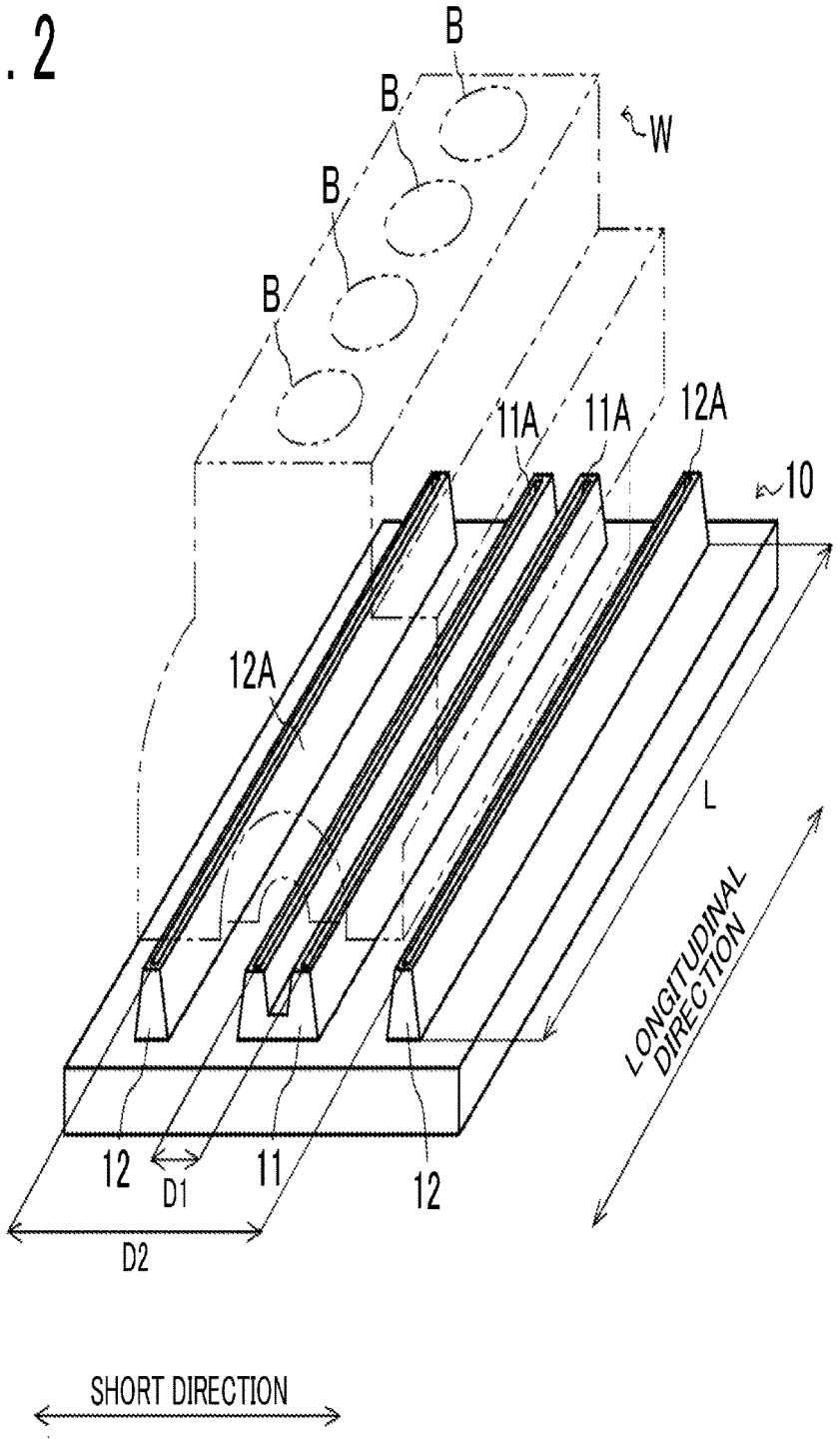
FIG. 2 is a schematic view showing a configuration of a feed unit.

A configuration of the feed unit 10 will be described using FIG. 2. FIG. 2 schematically shows the configuration of the feed unit 10 as a perspective view. Hereinafter, the description will be made in accordance with the longitudinal direction (the array direction of bores B of the cylinder block W placed in the treatment chamber 16) and the short direction shown in FIG. 2. The short direction may be regarded as a direction perpendicular to the longitudinal direction. The short direction of the feed unit 10 can be regarded as a predetermined direction perpendicular to the axis direction and array direction of the bores B. For the simplification of the description, FIG. 2 transparently shows the cylinder block W by alternate long and short dashes line.

The bores B are formed on an upper part of the cylinder block W placed in the treatment chamber 16. Further, on a lower part of the cylinder block W, crank chambers C are formed so as to be continuous with the bores B (see FIG. 3, FIG. 4A and FIG. 4B).

That is, a lower part of the bore B is continuous with an upper part of the crank chamber C, in the axis direction of the bore B. It may be regarded that the bore B and the crank chamber C form a through-hole that communicates in the vertical direction of the cylinder block W.

Further, the plurality of bores B formed on the cylinder block W are arrayed in a direction orthogonal to the axis direction of the bores B (in the longitudinal direction in FIG. 2). Here, the cylinder block W in the embodiment is formed of an aluminum alloy.

The feed unit 10 feeds circulating air to the cylinder block W by sending the circulating air into the treatment chamber 16 through first feed parts 11 and second feed parts 12 described later. The feed unit 10 is arranged below the cylinder block W placed in the treatment chamber 16.

In other words, the feed unit 10 is arranged on the crank chamber C side in the axis direction of the bores B of the cylinder block W. The feed unit 10 includes the first feed parts 11 and the second feed parts 12.

The first feed parts 11 are formed so as to be adjacent in parallel to each other along the longitudinal direction, at a nearly central part of the feed unit 10 in the short direction. Each of the first feed parts 11 is formed such that the cross-sectional view in the short direction (the cross-sectional shape when the first feed part 11 is cut along the short direction and the axis direction of the bores B) is a nearly trapezoidal shape.

First feed holes 11A that are jet orifices for the air are opened on the pointed end sides of the first feed parts 11 (on the downstream side in the flow direction of the circulating air). Each of the first feed holes 11A has a slit (long and thin hole) shape.

The first feed parts 11 are arranged below the crank chambers C of the cylinder block W (on the upstream side in the flow direction of the circulating air) (see FIG. 3), and the circulating air is fed from the first feed holes 11A toward the bores B of the cylinder block W in the treatment chamber 16.

Here, the length of the first feed parts 11 in the longitudinal direction is defined as L. Further, the length between the first feed holes 11A in the short direction is defined as an interval D1.

The second feed parts 12 are formed in parallel to each other along the longitudinal direction. The first feed parts 11 are arranged between the second feed parts 12 with respect to the short direction of the feed unit 10. Each of the second feed parts 12 is formed such that the cross-sectional view in the short direction (the cross-sectional shape when the second feed part 12 is cut along the short direction and the axis direction of the bores B) is a nearly trapezoidal shape.

Second feed holes 12A that are jet orifices for the air are opened on the pointed end sides of the second feed parts 12 (on the downstream side in the flow direction of the circulating air). Each of the second feed holes 12A has a slit (long and thin hole) shape.

The second feed parts 12 are arranged below both lateral surfaces (the outer lateral surfaces of both sides) of the cylinder block W that extend in the longitudinal direction of the cylinder block W (on the upstream side in the flow direction of the circulating air), and the circulating air is fed from the second feed holes 12A toward both lateral surfaces of the cylinder block W in the treatment chamber 16. Hereinafter, in some cases, "both lateral surfaces of the cylinder block W that extend in the longitudinal direction of the cylinder block W" is merely referred to as "both lateral surfaces of the cylinder block W".

Here, the length of the second feed parts 12 in the longitudinal direction is the same (the length L) as the length of the first feed parts 11 in the longitudinal direction. Further, the length between the second feed holes 12A in the short direction is defined as an interval D2.

Figure 3:
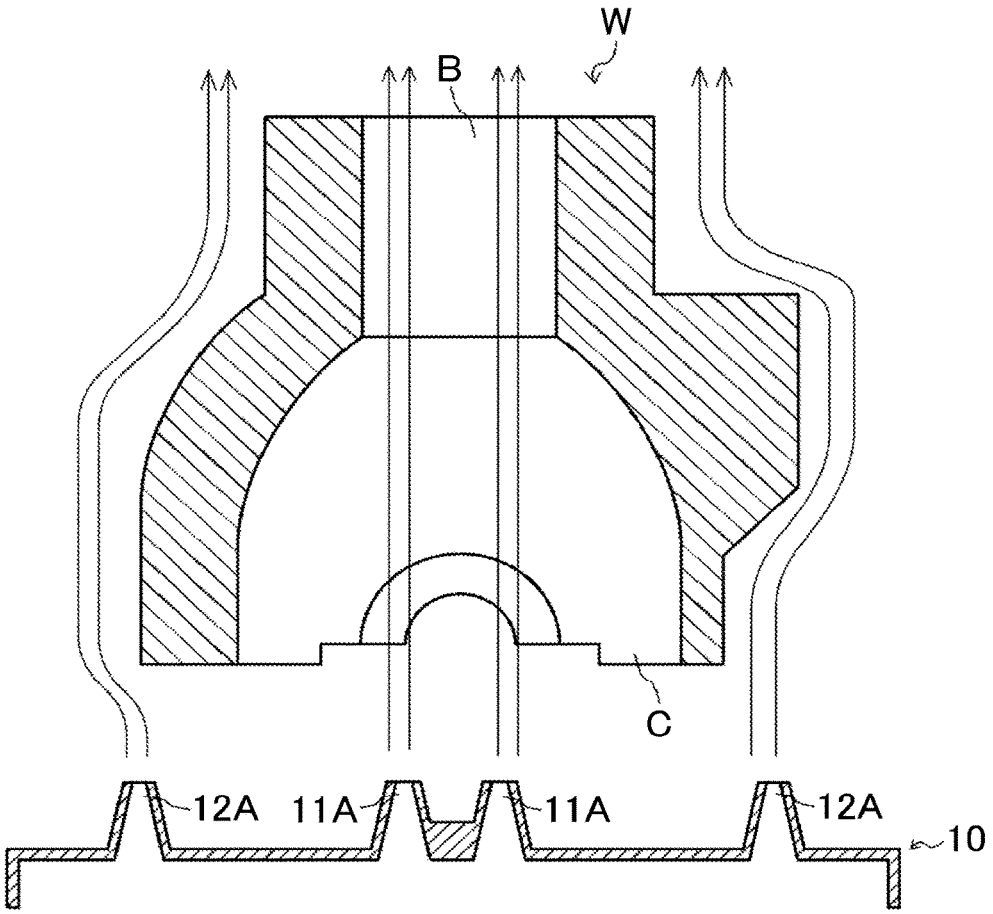
FIG. 3 is a schematic view showing an action of the feed unit.

An action of the feed unit 10 will be described using FIG. 3. Here, FIG. 3 schematically shows the action of the feed unit 10 as a cross-sectional view in the short direction. Further, the arrows in FIG. 3 show the flow of the air.

The air fed from the first feed holes 11A into the treatment chamber 16 goes from below the crank chambers C of the cylinder block W toward the bores B. Therefore, by the Coanda effect, the air flows along the inner circumferential surface (heating surface) of a part where the crank chambers C and bores B of the cylinder block W are formed, and efficiently transfers heat to the part where the crank chambers C and bores B of the cylinder block W are formed.

Further, the air fed from the second feed holes 12A into the treatment chamber 16 goes from below the cylinder block W toward both lateral surfaces of the cylinder block W. Therefore, by the Coanda effect, the air flows along both lateral surfaces (heating surfaces) of the cylinder block W, and efficiently transfers heat to the heating surfaces.

In this way, the air is fed along the inner circumferential surface (heating surface) of the part where the crank chambers C and the bores B are formed and both lateral surfaces (heating surfaces) of the cylinder block W, whose areas are relatively large among the surfaces of the cylinder block W. Therefore, the fed air efficiently transfers heat to the cylinder block W. For example, in the case where hot air is fed to the cylinder block W, it is possible to efficiently raise the temperature of the cylinder block W in a short time.

Here, the Coanda effect means that fluid, by its property, tends to flow along a body when the body is placed in the flow.

Figure 4A:
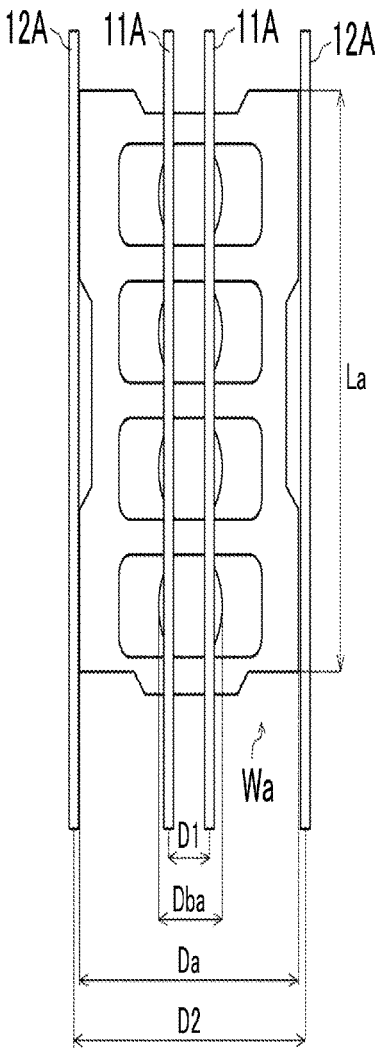
FIG. 4A is a first schematic view showing a positional relation between the feed unit and the cylinder block.
Figure 4B:
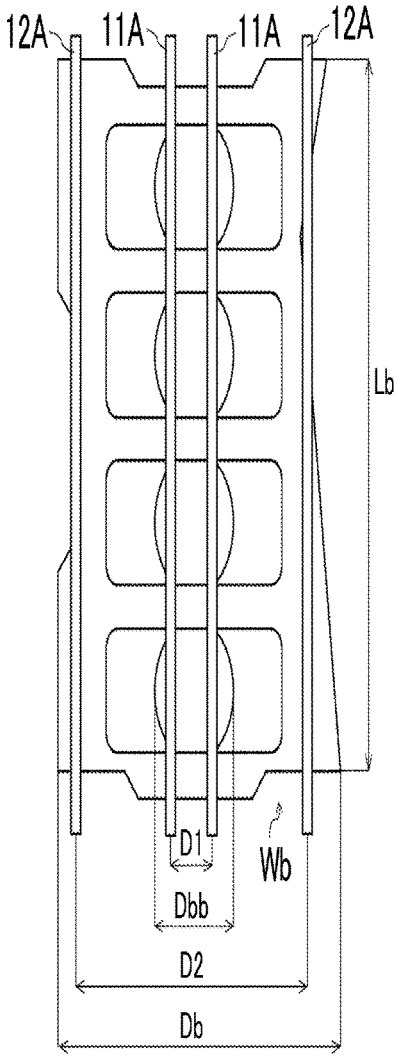
FIG. 4B is a second schematic view showing a positional relation between the feed unit and the cylinder block.

Positional relations of the feed unit 10 to a cylinder block Wa and a cylinder block Wb will be described using FIG. 4A and FIG. 4B. The size of the cylinder block Wa and the size of the cylinder block Wb are different from each other. FIG. 4A schematically shows the positional relation between the feed unit 10 and the cylinder block Wa as a bottom view. FIG. 4B schematically shows the positional relation between the feed unit 10 and the cylinder block Wb as a bottom view.

In the heat treatment apparatus 100, the heat treatment is performed for a plurality of cylinder blocks W. Here, among the cylinder blocks W to be subjected to the heat treatment in the heat treatment apparatus 100, the smallest cylinder block W is defined as the cylinder block Wa, and the largest cylinder blocks W is defined as the cylinder block Wb.

As shown in FIG. 4A, the cylinder block Wa is arranged above the feed unit 10 (not illustrated). Here, the length of the cylinder block Wa in the longitudinal direction of the cylinder block Wa is defined as La, and the length of the cylinder block Wa in the short direction of the cylinder block Wa is defined as a width Da. Further, the diameter of the bore B of the cylinder block Wa is defined as a diameter Dba.

The length L of the first feed hole 11A and the second feed hole 12A is sufficiently greater than the length La of the cylinder block Wa, in the longitudinal direction of the cylinder block Wa. Further, suppose that the interval D2 between the second feed holes 12A is equal to the width Da of the cylinder block Wa or greater than the width Da in the short direction of the cylinder block Wa. Furthermore, suppose that the interval D1 between the first feed holes 11A is equal to the diameter Dba of the bore B of the cylinder block Wa or less than the diameter Dba.

As shown in FIG. 4B, the cylinder block Wb is arranged above the feed unit 10. Here, the length of the cylinder block Wb in the longitudinal direction of the cylinder block Wb is defined as Lb, and the length of the cylinder block Wb in the short direction of the cylinder block Wb is defined as a width Db. Further, the diameter of the bore B of the cylinder block Wb is defined as a diameter Dbb.

The length L of the first feed hole 11A and the second feed hole 12A is slightly greater than the length Lb of the cylinder block Wb, in the longitudinal direction of the cylinder block Wb. Further, suppose that the interval D2 between the second feed holes 12A is equal to the width Db of the cylinder block Wb or less than the width Db in the short direction of the cylinder block Wb. Furthermore, suppose that the interval D1 between the first feed holes 11A is equal to the diameter Dbb of the bore B of the cylinder block Wb or less than the diameter Dbb. In other words, the first feed holes 11A are arranged below the bores B of the cylinder block Wa and the cylinder block Wb.

Further, the interval D2 between the second feed holes 12A is set so as to be equal to or greater than the width Da of the cylinder block Wa and to be equal to or less than the width Db of the cylinder block Wb. That is, the second feed holes 12A are arranged, with respect to the short direction, outside both lateral surfaces of the cylinder block Wa that extend in the longitudinal direction of the cylinder block Wa, and are arranged, with respect to the short direction, inside both lateral surfaces of the cylinder block Wb. Hereinafter, in some cases, "both lateral surfaces of the cylinder block Wa (Wb) that extend in the longitudinal direction of the cylinder block Wa (Wb)" is merely referred to as "both lateral surfaces of the cylinder block Wa (Wb)".

Figure 5:
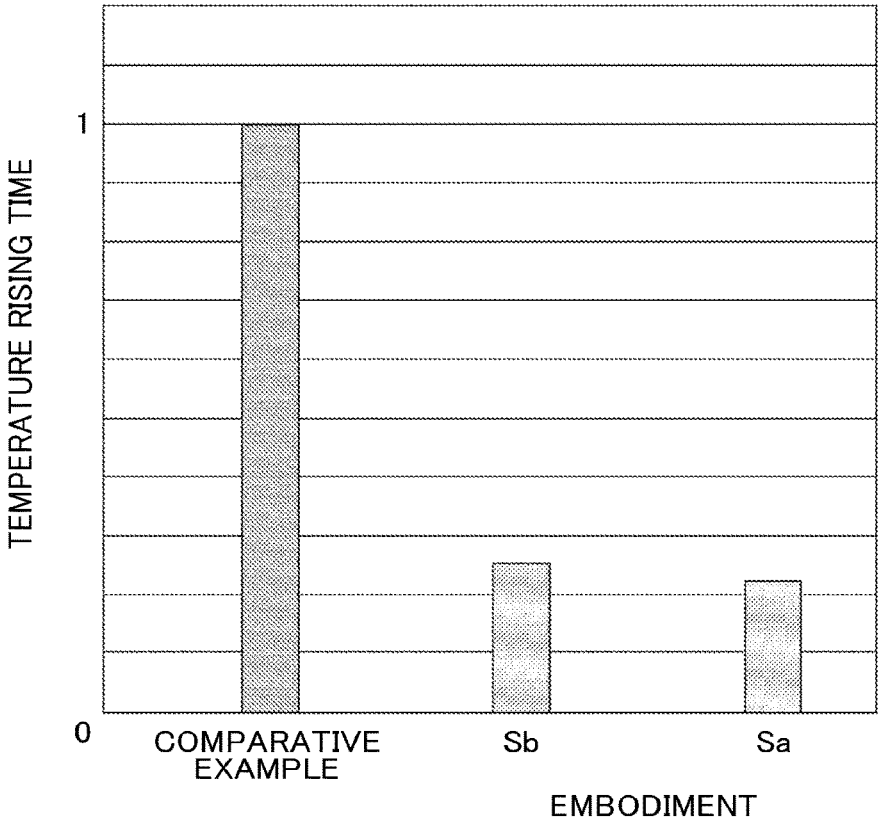
FIG. 5 is a graph showing an effect of the heat treatment apparatus.
Figure 6:
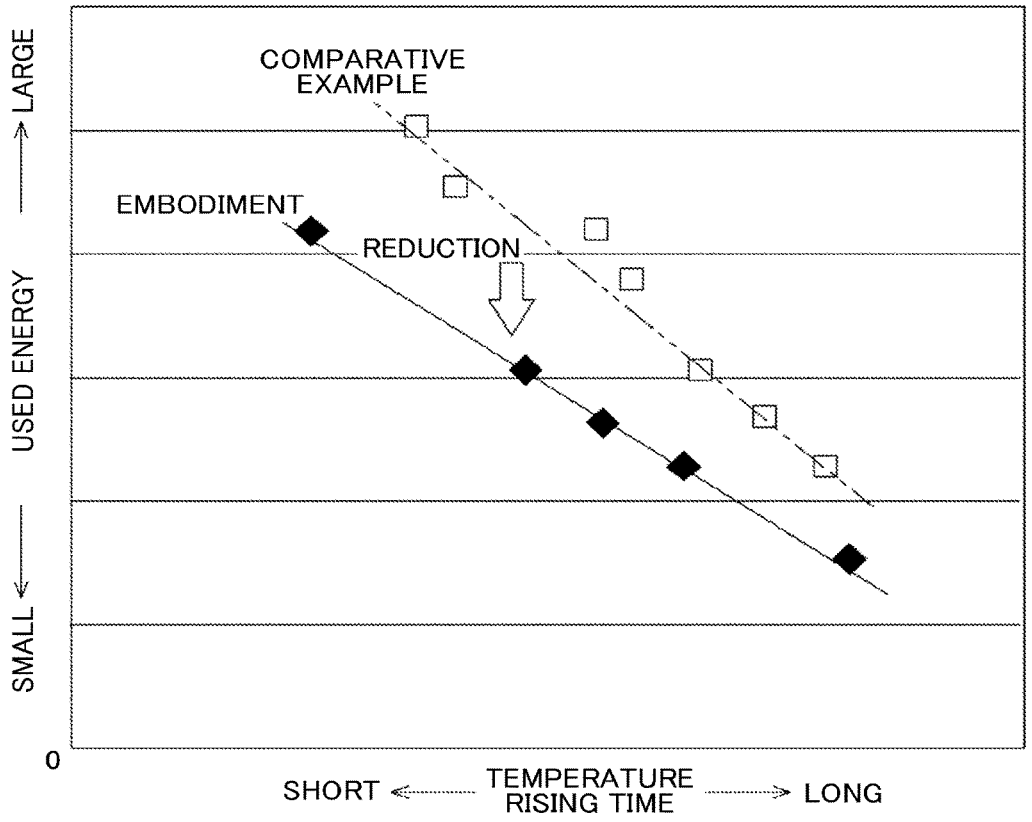
FIG. 6 is another graph showing the effect of the heat treatment apparatus.

An effect of the heat treatment apparatus 100 will be described using FIG. 5 and FIG. 6. FIG. 5 and FIG. 6 shows the effect of the heat treatment apparatus 100 in the case of using the feed unit 10, as graphs showing comparisons between a comparative example using a feed unit (hereinafter, referred to as a standard feed unit) with a punched shape in which through-holes are evenly formed across the whole of a plate member and an embodiment of the invention.

In FIG. 5, the ordinate indicates the temperature rising time of the cylinder block W, and the temperature rising time of the cylinder block Wa in the comparative example using the standard feed unit is defined as 1. FIG. 5 shows the temperature rising time of the cylinder block Wa in the comparative example using the standard feed unit, the temperature rising time of the cylinder block Wa in the embodiment of the invention using the feed unit 10, and the temperature rising time of the cylinder block Wb in the embodiment of the invention using the feed unit 10.

Further, in FIG. 6, the abscissa indicates the temperature rising time of the cylinder block W, and the ordinate indicates the energy used in the heat treatment apparatus (the energy used in the circulation fan 51, the heater 52 and the like). Each numerical value is shown as a non-dimensional value.

According to the heat treatment apparatus 100, it is possible to efficiently raise the temperature of the cylinder block W. That is, according to the heat treatment apparatus 100, the air is fed along the inner circumferential surface (heating surface) of the part where the crank chambers C and the bores B are formed, and thereby, the fed air efficiently transfers heat to the cylinder block W, so that the heat treatment of the cylinder block W is efficiently performed in a short time.

Further, the heat treatment apparatus 100 is configured to feed the air along both lateral surfaces of the cylinder block W, in addition to the inner circumferential surface of the part where the crank chambers C and the bores B are formed. Therefore, it is possible to further promote the heat transfer to the cylinder block W, and it is possible to further efficiently perform the heat transfer to the cylinder block W in a short time.

Particularly, since each of the first feed holes 11A has a slit shape, the air jetted from the first feed holes 11A is fed intensively to the inner circumferential surface of the part where the crank chambers C and bores B of the cylinder block W are formed so that the heat treatment of the cylinder block W is efficiently performed.

Similarly, since each of the second feed holes 12A has a slit shape, the air jetted from the second feed holes 12A is fed intensively to both lateral surfaces of the cylinder block W so that the heat treatment of the cylinder block W is efficiently performed.

Further, in the heat treatment apparatus 100, the first feed holes 11A are arranged below the bores B of the cylinder block Wa and the cylinder block Wb (on the upstream side in the flow direction of the air). Further, in the heat treatment apparatus 100, the first feed holes 11A is longer than the cylinder block Wb in the longitudinal direction of the cylinder block Wb. Therefore, according to the heat treatment apparatus 100, it is possible to exert the above-described effect for variously sized cylinder blocks W ranging from the smallest cylinder block Wa to the largest cylinder block Wb, and to enhance the versatility.

Similarly, the second feed holes 12A are arranged, with respect to the short direction of the cylinder block Wa, outside both surfaces of the cylinder block Wa and inside both surfaces of the cylinder block Wb. Therefore, it is possible to exert the above-described effect for variously sized cylinder blocks W ranging from the smallest cylinder block Wa to the largest cylinder block Wb, and to enhance the versatility.

As shown in FIG. 5, when the temperature rising time by the standard feed unit is 1, the heat treatment apparatus 100 can reduce the temperature rising times for the cylinder block Wa and the cylinder block Wb, to about ¼.

As shown in FIG. 6, the energy (the solid line in FIG. 6) used in the heat treatment apparatus 100 using the feed unit 10 is reduced regardless of the temperature rising time, compared to the energy (the alternate long and short dashes line in FIG. 6) used in the heat treatment apparatus using the standard feed apparatus. That is, according to the heat treatment apparatus 100, it is possible to efficiently heat the cylinder block W, and to achieve energy conservation.

The feed unit 10 in the embodiment is used in the heat treatment apparatus 100 that performs the temperature rising of the cylinder block W for aging treatment, but the invention is not limited to the embodiment. For example, the feed unit 10 may be used in the heat treatment apparatus 100 that performs the temperature falling (cooling) of the cylinder block W.

The heat treatment apparatus 100 in the embodiment adopts the configuration in which the feed unit 10 is arranged below the cylinder block W, but the invention is not limited to the embodiment. For example, in the case where the circulation direction of the air is the opposite direction to that in the embodiment, the feed unit 10 may be arranged above the cylinder block W, to feed the air into the treatment chamber 16. That is, the feed unit 10 only needs to be on one side of a first side and a second side that sandwich the bores B in the axis direction of the bores B of the cylinder block W placed in the treatment chamber 16, and to be arranged on the upstream side in the flow direction of the air.

What is claimed is:

1. A heat treatment apparatus for a cylinder block, the heat treatment apparatus performing heat treatment by feeding gas, the heat treatment apparatus comprising:

a first feed part configured to feed the gas toward bores of the cylinder block, from a first side or a second side of the bores in an axis direction of the bores; and a second feed part configured to feed the gas toward a lateral surface of the cylinder block from the first side or the second side, the lateral surface of the cylinder block extending in an array direction of the bores, wherein the first feed part includes a first feed hole that is a jet orifice for the gas, wherein the second feed part includes a second feed hole that is a jet orifice for the gas, and wherein at least one of the first feed hole and the second feed hole is a slit along the array direction of the bores of the cylinder block.

2. The heat treatment apparatus according to claim 1, wherein:

the cylinder block includes a plurality of cylinder blocks; and the first feed hole and the second feed hole are longer in the array direction of the bores than a cylinder block that is of the cylinder blocks to be subjected to the heat treatment and that has the longest length in the array direction of the bores.

3. The heat treatment apparatus for the cylinder block according to claim 1, wherein:

the cylinder block includes a plurality of cylinder blocks;

the second feed hole is arranged, with respect to a predetermined direction perpendicular to the axis direction and the array direction of the bores, outside both lateral surfaces of a cylinder block that is of the cylinder blocks to be subjected to the heat treatment and that has the shortest length in the predetermined direction; and the second feed hole is arranged, with respect to the predetermined direction, inside both lateral surfaces of a cylinder block that is of the cylinder blocks to be subjected to the heat treatment and that has the longest length in the predetermined direction.

4. A heat treatment method for a cylinder block, comprising:

performing heat treatment for the cylinder block by feeding gas toward bores of the cylinder block with a first feed part, from a first side or a second side of the bores in an axis direction of the bores, feeding the gas with a second feed part toward a lateral surface of the cylinder block from the first side or the second side, the lateral surface of the cylinder block extending in an array direction of the bores, wherein the first feed part includes a first feed hole that is a jet orifice for the gas, wherein the second feed part includes a second feed hole that is a jet orifice for the gas, and wherein at least one of the first feed hole and the second feed hole is a slit along the array direction of the bores of the cylinder block.

* * * * *